United States Patent [19]

Pain

[11] 4,448,243

[45] May 15, 1984

[54] HEAT EXCHANGER

[75] Inventor: John R. Pain, Montmorency, Australia

[73] Assignee: Heat Transfer Pty. Ltd., Victoria, Australia

[21] Appl. No.: 278,080

[22] Filed: Jun. 29, 1981

[51] Int. Cl.[3] ..... F28F 19/00

[52] U.S. Cl. ..... 165/134 R; 165/11 R; 165/70; 165/154; 165/165; 285/41

[58] Field of Search ..... 165/11, 70, 154, 165, 165/134; 285/41

[56] References Cited

U.S. PATENT DOCUMENTS

| | | | |
|---|---|---|---|
| 3,522,008 | 7/1970 | Defabaugh | 165/11 |
| 4,054,981 | 10/1977 | Bridgegum | 165/70 |
| 4,146,088 | 3/1979 | Pain | 165/141 |
| 4,177,858 | 12/1979 | Daman | 165/11 |
| 4,228,848 | 10/1980 | Wadkinson | 165/11 |

FOREIGN PATENT DOCUMENTS 489080 5/1977 Australia .

489755 5/1977 Australia .

*Primary Examiner*—Albert W. Davis, Jr.
*Assistant Examiner*—S. Gayle Dotson

[57] ABSTRACT

The specification discloses a heat exchanger of particular construction and methods of using same, the exchanger having pairs of sealing elements through which a circulating fluid is passed. The circulating fluid can be used for leak detection, cooling, or sterilization. The exchanger has a plurality of coaxially arranged tubes of thermally conductive material, the tubes being spaced apart radially by a pair of end manifolds to form annular fluid flow passages at least one of the manifolds having first and second sealing elements for forming seals between the manifold and the ends of the tubes, circumferential fluid passages being defined between the first and second sealing elements, circulating fluid inlet means for admitting a circulating fluid at first locations in the passages, and circulating fluid outlet means for discharge of said circulating fluid at second locations in said passages, the first and second locations being circumferentially spaced for each passage.

8 Claims, 6 Drawing Figures

HEAT EXCHANGER

Figure 1:
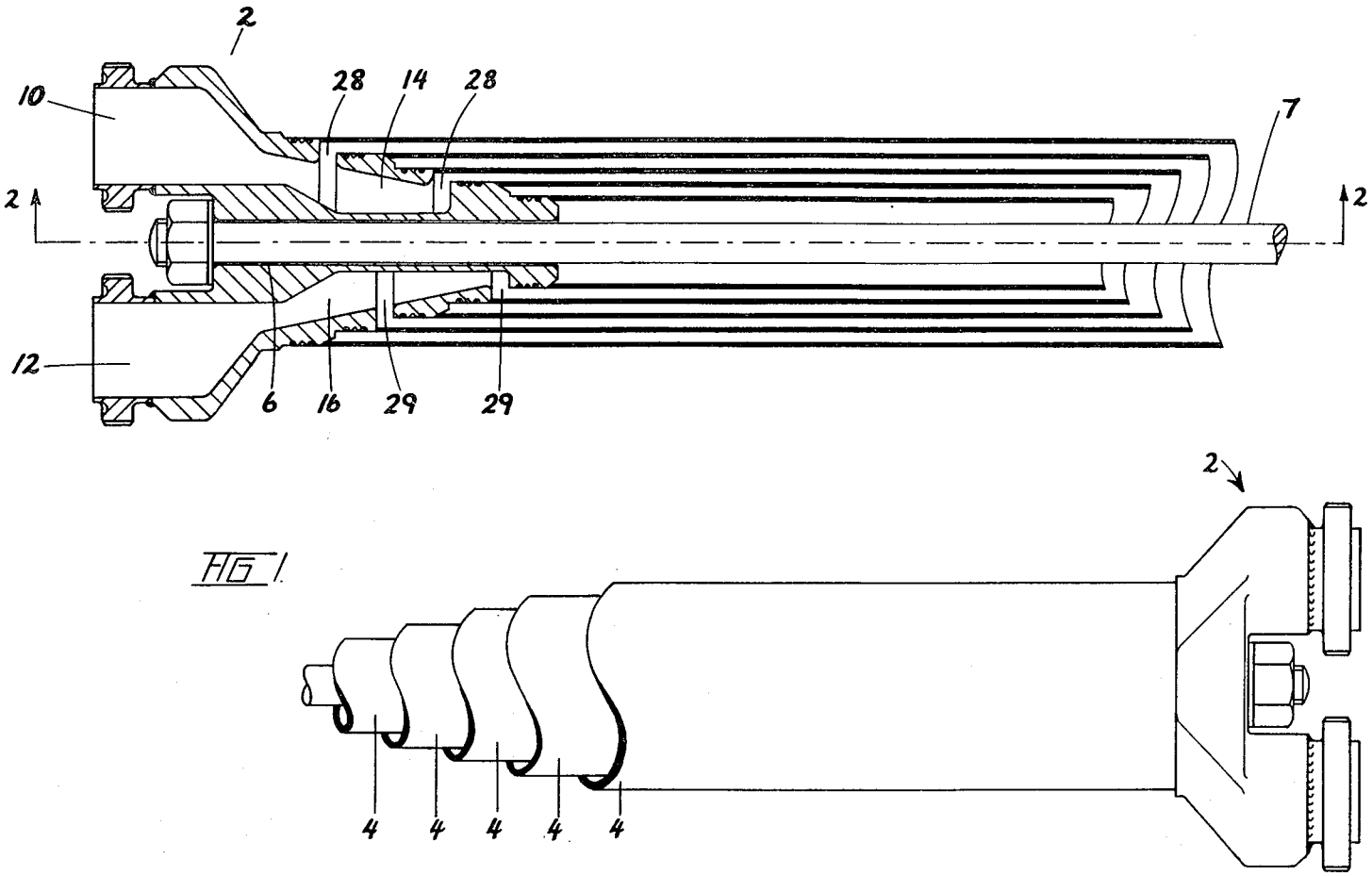

This invention relates to heat exchangers, particularly but not exclusively of the type shown in U.S. Pat. No. 4,146,088.

The aforementioned United States Patent discloses a heat exchanger comprising a plurality of concentric tubes clamped between end manifolds. The fluid flow passages for the heat exchanger are formed in the annular regions between adjacent tubes. The end manifolds include O-rings which sealingly engage the inner surfaces of the ends of the tubes.

The present invention concerns a modification to such exchangers which can advantageously be employed in several ways. Basically, the invention provides means for establishing flow of a purging fluid in the region between the O-ring or rings and the ends of the tubes. Such purging flow can firstly function as a coolant for cooling the O-rings and thereby making the exchanger more suitable for treatment of fluids at higher temperatures. Secondly, the purging fluid can be maintained at relatively higher pressure than the fluids flowing in the annular flow paths between adjacent fluids whereby if there is a leak between the O-rings and the ends of the tubes, the purging fluid will flow into such annular spaces and intermixing of the fluids being treated in the heat exchanger will not occur. Alternatively, the purging fluid could be kept at relatively low pressure and a monitoring system provided to detect the presence of either or both of the heat exchanger fluids in the purging fluid. Thus, if one or other of the heat exchanger fluids is detected, that will be indicative of a broken or damaged O-ring seal. Also the purging fluid could sterilize the passage between the O-rings thus eliminating biological contamination in the event of a damaged seal.

According to the present invention there is provided a heat exchanger for fluids comprising a plurality of coaxially arranged tubes of thermally conductive material, the tubes being spaced apart radially by a pair of end manifolds to form annular fluid flow passages at least one of said manifolds having first and second sealing elements for forming seals between the manifold and the ends of the tubes, circumferential fluid passages being defined between said first and second sealing elements, circulating fluid inlet means for admitting a circulating fluid at first locations in said passages, and circulating fluid outlet means for discharge of said circulating fluid at second locations in said passages, the first and second locations being circumferentially spaced for each passage.

The invention also provides a method of exchanging heat between a first fluid and a second fluid which is at a different temperature to the first fluid, said method including the steps of passing the first and second fluids through first and second fluid flow paths in a heat exchanger, said flow paths being isolated from one another by first and second sealing elements, there being a third fluid flow path defined between said first and second sealing elements, passing a circulating fluid through said third fluid flow path, and analysing the circulating fluid discharged from the third flow path to detect traces of the first or second fluid therein.

Figure 2:
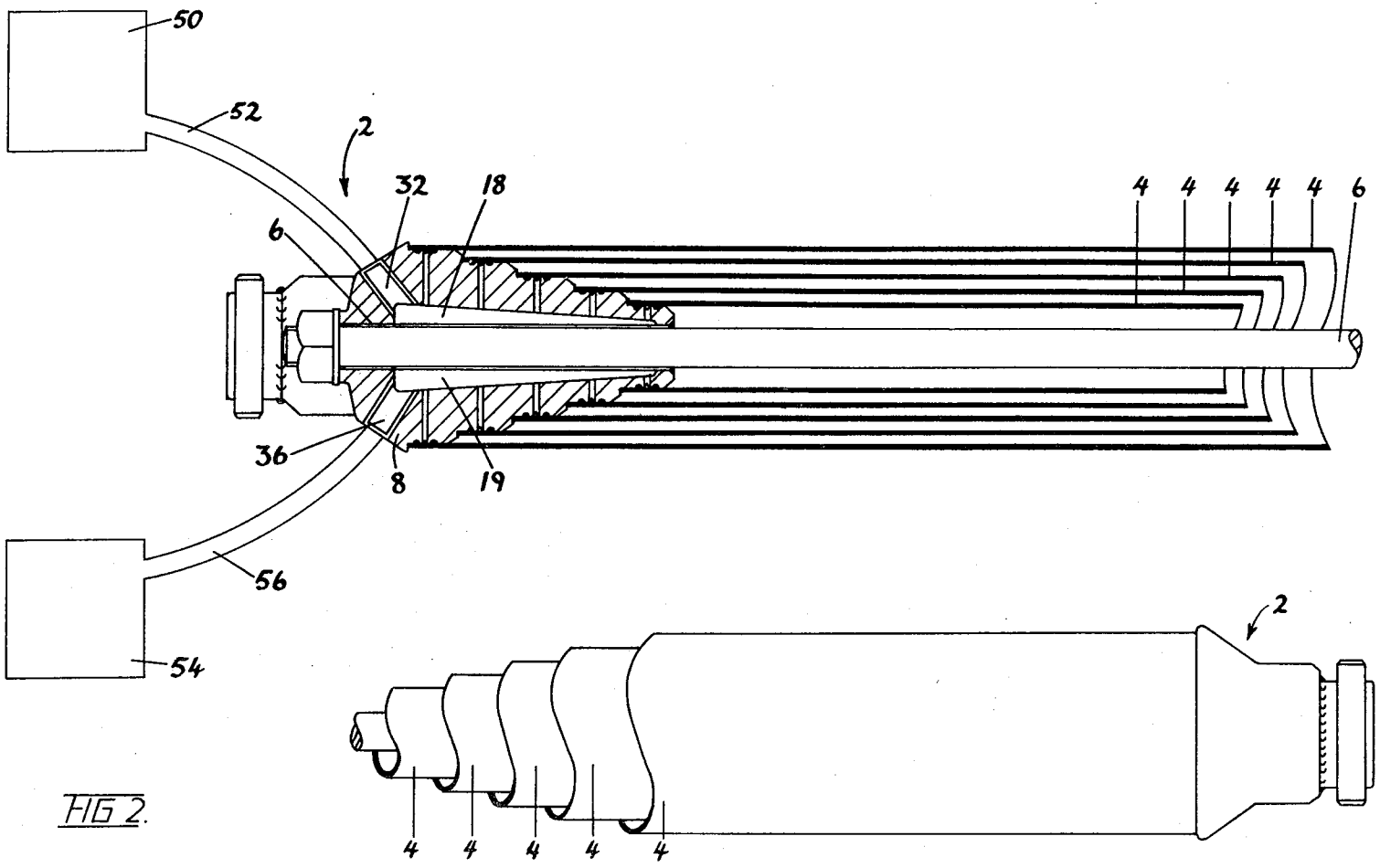
Figure 4:
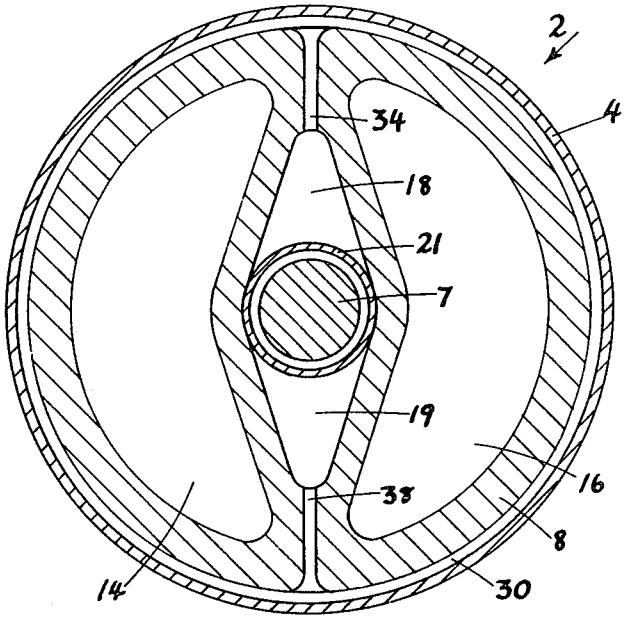
Figure 3:
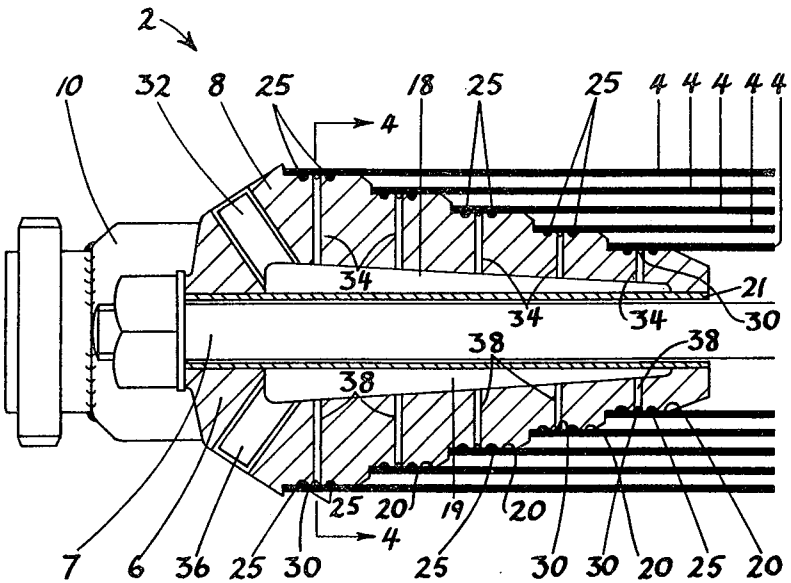

The invention will now be more fully described with reference to the accompanying drawings in which:

FIG. 1 is a longitudinal cross section through part of a heat exchanger constructed in accordance with the invention, FIG. 2 is a cross sectional view taken along the line 2—2 marked on FIG. 1, FIG. 3 is a more detailed view of part of the exchanger, and FIG. 4 is a sectional view taken along the line 4—4.

The heat exchanger of the invention comprises a pair of end manifolds 2 between which concentric heat conducting tubes 4 are disposed. The manifolds have a central bore 6 through which a long tension bolt 7 can pass therethrough and be used to clamp the tubes between the end manifolds. In the illustrated arrangement there are five tubes 4 each of which is preferably formed from stainless steel and may be provided with helical grooving (not shown) on its cylindrical wall so as to improve heat transfer properties. The spaces between adjacent tubes form annular fluid flow passages for the heat exchanger.

Both end manifolds 2 for the heat exchanger are the same and accordingly it is only necessary to describe the construction of one of the manifolds.

As best seen in FIGS. 1 and 3, each manifold comprises a generally conical body portion 8 integrally cast with tubular inlet/outlet spigots 10 and 12. The spigots 10 and 12 permit connection of fluid conduits to the end manifold by conventional means. The spigots 10 and 12 can be used interchangably as inlet or outlet but in the description which follows it will be assumed that the spigot 10 is used as an inlet for a first heat transfer fluid and the spigot 12 is used as an outlet for the second heat transfer fluid. The body portion 8 includes inlet chamber 14 and an outlet chamber 16 in communication respectively with the spigots 10 and 12. The conical portion 8 further includes a central opening which is divided into separate chambers 18 and 19 by a tube 21 forming a central chamber therein, the ends of the tube 21 passing through the bore 6 and being welded thereto.

The outer surface of the body portion 8 of the manifold includes a series of generally cylindrical portions 20 which are spaced axially along the body portion and are adapted to be inserted within respective ends of the tubes 4, the cylindrical portions 20 being interconnected by tapering transition portions. Each cylindrical portion has formed therein two spaced grooves for receipt of O-rings 25 for forming positive seals with the inner surfaces of the tubes 4. A shoulder is formed at the end of each of the cylindrical portions 20 so as to form a seat against which the ends of the tubes 4 bear.

Fluid chambers 14 and 16 are connected to the annular fluid passages defined between adjacent tubes 4 by way of radial recesses 28 and 29 formed into the transition portions as best seen in FIG. 1.

In accordance with the present invention means is provided to establish flow of a circulating or purging fluid between the respective pairs of O-rings 25. Grooves 30 are formed in the body portion 8 between the pairs of O-rings 25 so as to form circumferential flow passages for the purging fluid. As best seen in FIG. 3, the manifold includes a purging fluid inlet duct 32 opens into the chamber 18 which has a number of generally radial inlet ducts 34 which communicate with respective grooves 30. On the opposite side of the body portion 8, there is formed a purging fluid outlet duct 36 which opens into the chamber 19 which has a number of generally radial return passages 38 from the grooves 30. As best seen in FIG. 4 the purging fluid will then flow from the chamber 18 through the passages 34 then follow generally semi-circular paths along the grooves 30 and between the pairs of O-rings 25. The fluid will then flow into the return passages 38 to the return chamber 19.

In one application the purging fluid can be used as a coolant to cool the O-rings 25 to thereby enable the heat exchanger to be used with heat transfer fluids at relatively high temperatures. In a second application, the purging fluids may be circulated at a pressure which is higher than one or other of the pressures of the first and second heat transfer fluids so that should there be any leakage at the O-rings 25 the purging fluid will flow into the heat transfer passages between the tubes rather than intermixing of the heat transfer fluids.

Alternatively, the purging fluid may be circulated at relatively low pressure compared to the heat transfer fluids and monitoring apparatus provided to monitor the presence of one or other of the heat transfer fluids in the purging fluid so as to provide an effective means of detecting a broken or damaged O-ring. This arrangement is schematically illustrated in FIG. 2 which shows a purging fluid supply 50 connected by a conduit 52 to the inlet duct 32 and a purging fluid analyser 54 connected by a conduit 56 to the outlet duct 36. The analyser monitors the presence of traces of one or both of the fluids flowing through the inlet 10 and outlet 12 of the exchanger. The supply and analyser could be operated continuously or periodically. There may be a return path for purging fluid from the analyser 54 to the supply 50.

Many modifications will be apparent to those skilled in the art without departing from the spirit and scope of the invention. For instance the principles of the invention could be utilised in the exchanger disclosed in Australian Pat. No. 489755 or in any other exchanger which utilises a pair of seals between the main flow paths for the fluids.

I claim:

1. A heat exchanger for primary and secondary fluids between which heat exchange occurs, said exchanger comprising at least first, second and third coaxially disposed tubes of successively larger diameters, said tubes being spaced apart by a pair of end manifolds to form annular fluid flow passages for said primary and secondary fluids between adjacent tubes, at least one of said manifolds having a generally conical portion and having first, second and third pairs of sealing elements which sealingly engage the inner surfaces of the first, second and third tubes respectively, circumferential flow passages located between the sealing elements of at least said second pair, said conical portion including first and second chambers formed therein for the primary and secondary fluids and wherein, in transverse section of said conical portion, said first and second chambers lie on opposite sides of a diametrical line, a third chamber located in said conical portion between said first and second chambers, a tubular member extending through third chamber so as to divide said third chamber into three chambers: one central chamber within said tubular member, and circulating fluid inlet and outlet chambers on opposite sides of said central chamber, said diametrical line passing through said circulating fluid inlet and outlet chambers and said central chamber, said conical portion further including generally radial ducts extending from respective circulating fluid inlet and outlet chambers to said circumferential flow passage on generally opposite sides thereof, said manifold further including circulating fluid inlet and outlet ducts for fluid communication to the circulating fluid inlet and outlet chambers respectively whereby in use circulating fluid can pass through the circulating fluid inlet duct, to the circulating fluid inlet chamber, through one of the radial ducts to the circumferential passage and can flow through the passage and enter the other radial duct, then flow through the circulating fluid outlet chamber and thence out of the circulating fluid outlet duct.

2. A heat exchanger as claimed in claim 1 wherein there are further of said tubes of successively larger diameters all coaxially disposed and having pairs of sealing elements which sealingly engage the inner surfaces of the tubes and wherein there are circumferential flow passages between each pair of sealing elements.

3. A heat exchanger as claimed in claim 2 wherein both of said end manifolds are the same and wherein an elongate tension bolt extends within the first tube and through said tubular members and maintains the ends of the tubes seated against shoulders formed in the conical portions of said manifolds.

4. A heat exchanger as claimed in claim 3 wherein said sealing elements comprise O-rings and wherein circulating fluid supply means is coupled to said circulating fluid supply duct, said supply means being arranged in use to supply circulating fluid at a relatively low temperature so as to cool said O-rings.

5. A heat exchanger as claimed in claim 1 wherein both of said end manifolds are the same and wherein an elongate tension bolt extends within the first tube and through said tubular members and maintains the ends of the tubes seated against shoulders formed in the conical portions of said manifolds.

6. A heat exchanger as claimed in claim 1 wherein said sealing elements comprise O-rings and wherein circulating fluid supply means coupled to said circulating fluid inlet duct is arranged in use to supply circulating fluid at a relatively low temperature so as to cool said O-rings.

7. A heat exchanger as claimed in claim 6 wherein both of said end manifolds have similar generally conical portions and wherein an elongate tension bolt extends within the first tube and through said tubular members in said end manifolds and maintains the ends of the tubes seated against shoulders formed in the conical portions of said manifolds.

8. A heat exchanger as claimed in claim 7 wherein each said end manifold includes circumferential flow passages between each said pair of O-ring sealing elements and corresponding generally radial ducts extending from respective circulating fluid inlet and outlet chambers to each said circumferential flow passage on generally opposite sides thereof.

* * * * *